US007748293B2

(12) United States Patent
Elwell

(10) Patent No.: US 7,748,293 B2
(45) Date of Patent: Jul. 6, 2010

(54) PILL CONTAINER OPENER

(75) Inventor: Michael Peter Elwell, 48100 Cooper Foster Rd., Amherst, OH (US) 44001

(73) Assignee: Michael Peter Elwell, Chagrin Falls, OH (US)

( * ) Notice: Subject to any disclaimer, the term of this patent is extended or adjusted under 35 U.S.C. 154(b) by 118 days.

(21) Appl. No.: 12/117,303

(22) Filed: May 8, 2008

(65) Prior Publication Data

US 2009/0277306 A1 Nov. 12, 2009

(51) Int. Cl.
*B67B 7/14* (2006.01)

(52) U.S. Cl. ..... 81/3.4; 7/151

(58) Field of Classification Search ..... 81/3.08, 81/3.09, 3.4, 176.1–176.2; 7/151; D8/33–34, D8/18

See application file for complete search history.

(56) References Cited

U.S. PATENT DOCUMENTS

| | | | | | |
|---|---|---|---|---|---|
| 2,702,652 | A | | 2/1955 | Joyce | |
| 2,985,044 | A | * | 5/1961 | Gill | 81/3.4 |
| 3,812,741 | A | * | 5/1974 | Heine | 81/3.4 |
| 3,885,478 | A | | 5/1975 | Evans | |
| 3,913,424 | A | | 10/1975 | Castillo | |
| 4,073,205 | A | | 2/1978 | Silliman | |
| 4,084,723 | A | | 4/1978 | Parker | |
| 4,507,988 | A | * | 4/1985 | LoFaso et al. | 81/3.09 |
| 4,615,242 | A | | 10/1986 | Milin | |
| 4,702,129 | A | | 10/1987 | Allen | |
| 4,760,763 | A | * | 8/1988 | Trick et al. | 81/3.09 |
| 4,770,069 | A | | 9/1988 | Miken | |
| 4,911,038 | A | * | 3/1990 | Ferrin | 81/3.09 |
| 5,313,859 | A | | 5/1994 | Garby | |
| 5,388,297 | A | | 2/1995 | Ross | |
| 5,621,936 | A | | 4/1997 | Penaligon | |
| 5,704,258 | A | | 1/1998 | LaVoie | |
| 5,727,704 | A | | 3/1998 | Glynn | |
| 5,735,181 | A | | 4/1998 | Anderson | |
| 5,803,285 | A | * | 9/1998 | Hirota | 215/296 |
| 5,836,221 | A | | 11/1998 | Hystead | |
| 5,974,916 | A | * | 11/1999 | Lassiter | 81/121.1 |
| 6,205,888 | B1 | | 3/2001 | Laudani | |
| 6,273,761 | B1 | | 8/2001 | Hsu | |
| 6,393,947 | B1 | | 5/2002 | Corcoran | |
| 6,415,688 | B1 | | 7/2002 | Smith | |
| 6,651,531 | B1 | | 11/2003 | Thornton | |
| 6,874,389 | B1 | | 4/2005 | Thornton | |
| 7,028,359 | B2 | | 4/2006 | Mazur | |
| 7,340,979 | B2 | * | 3/2008 | Sawyer | 81/3.4 |
| 7,387,049 | B1 | * | 6/2008 | Ver Hage et al. | 81/3.4 |
| 2003/0150297 | A1 | * | 8/2003 | Mazur | 81/3.09 |
| 2008/0011127 | A1 | | 1/2008 | Mazur | |
| 2008/0072709 | A1 | | 3/2008 | Dye | |

* cited by examiner

*Primary Examiner*—D. S Meislin
(74) *Attorney, Agent, or Firm*—Fay Sharpe LLP; Brian E. Turung

(57) ABSTRACT

A container opener that is used by a user to remove a cap of a bottle or container such as, but not limited to, a medicine bottle or container that includes a childproof cap. The container opener includes a cavity that is designed to at least partially receive the cap of a bottle or container. The cavity can include one or more gripping elements designed to engage the cap when inserted in the cavity. The cavity can be designed to receive a plurality of different sized caps. The container can include a magnifier.

16 Claims, 9 Drawing Sheets

PILL CONTAINER OPENER

The present invention relates generally to a container opener, and more particularly to a manual pill container opener.

BACKGROUND OF THE INVENTION

Many elderly people, disabled people, and people with arthritis can sometimes have difficulty in opening medicine bottles or containers. Many prescription medicines are packaged in childproof containers. Such childproof containers, while extremely successful in preventing the accidental opening by a child can be difficult to open. Individuals having limited dexterity in their hands and fingers also experience difficulty when attempting to open these closures.

Many devices have been developed to assist individuals in opening pill bottles or containers. Several of these devices are disclosed in U.S. Pat. Nos. 2,702,652; 3,885,478; 3,913,424; 4,073,205; 4,084,723; 4,615,242; 4,702,129; 4,760,763; 4,770,069; 5,313,859; 5,388,297; 5,621,936; 5,704,258; 5,727,704; 5,735,181; 5,836,221; 6,205,888; 6,263,761; 6,393,947; 6,415,688; 6,651,531; 6,874,389; 7,028,359; and U.S. Patent Publication Nos. 2008/0011127 and 2008/0072709, all of which are incorporated fully herein by reference.

Several of these devices are complicated to operate or are too large or bulky to fit in a pocket or purse for use when a person is traveling or away from home. Several of these devices are power operated devices that require batteries or a power outlet to operate.

In addition to the difficulties of many individuals to open pill bottles or containers, some individuals have impaired eyesight thereby making it difficult to read the description and/or instructions on the pill bottle or container.

In view of the current state of the art, there is a demand for a pill container opener that can easily and conveniently open pill bottles or containers, and can be easily and conveniently carried in the pocket and/or purse of an individual. There is also a demand for a pill container opener that can assist reading material on a pill bottle or container and/or identify the contents in a pill bottle or container.

SUMMARY OF THE INVENTION

The present invention is directed to a manual container opening device that can be used to simplify the opening of bottles or containers such as, but not limited to childproof medicine bottles or containers. The container opening device of the present invention can be designed to facilitate in the removal of differing sized caps on pill bottles or containers; however, this is not required. The container opening device of the present invention can be designed to include a magnifier to facilitate in a user reading label information on a bottle or container, viewing the contents of a bottle or container, and/or viewing information on the medication; however, this is not required. The container opening device of the present invention can have an ergonomic configuration to facilitate in the use of the container opening device; however, this is not required.

In accordance with one non-limiting aspect of the present invention, there is provided a container opener that includes a body having top and bottom ends, wherein the bottom end includes a cavity opening that is designed to telescopically receive at least a portion of a cap on a bottle or container into the cavity of the container opener. The body of the container opening can have a constant or varied cross-sectional shape and/or area along the longitudinal length of the bottle opener. The cavity of the container opener can include one or more gripping elements that are designed to engage the cap on the bottle or container to facilitate in removal of the cap from the bottle or container; however, this is not required. In one non-limiting embodiment of the invention, the one or more gripping elements, when used, can include one or more tabs, ribs, barb, rough surface, sticky surface, high friction surface (e.g., a rubber surface, thermoplastic elastomer, etc.), and/or slots. In one non-limiting configuration, the cavity of the container opener includes one or more tabs. These one or more tabs can be designed to engage one or more slots that are formed in a cap of a bottle or container; however, this is not required. In another and/or alternative non-limiting configuration, the cavity includes a plurality of tabs. In still another and/or alternative non-limiting configuration, the cavity includes a plurality of tabs wherein adjacently positioned tabs are spaced at equal distances from one another; however, this is not required.

In accordance with another and/or alternative non-limiting aspect of the present invention, there is provided a container opener that is designed to remove different sized caps; however, this is not required. Many types of medicines are packaged in different sized bottles or containers. As such, different sized caps are used on such bottles or containers. The container opener of the present invention can be designed to enable a user to open different bottles or containers that include different sized and/or shaped caps. In one non-limiting embodiment of the present invention, the cavity of the container opener includes a plurality of regions of varying cross-sectional area so as to receive and engage a plurality of different sized caps. In one non-limiting design, along at least a portion of the longitudinal length of the cavity, the cross-sectional area reduces from the cavity opening to some point spaced from the cavity opening. The rate of tapering can be uniform or non-uniform. In another and/or alternative non-limiting design, a plurality of landings is positioned along in at least a portion of the longitudinal length of the cavity. In one non-limiting specific arrangement for this non-limiting design, at least two of the landings are spaced from one another along the longitudinal length of the cavity. In another and/or alternative non-limiting specific arrangement for this non-limiting design, the cross-section area of the cavity that includes a landing nearer to the cavity opening is greater than the cross-sectional area of the cavity that includes a landing that is spaced farther from the cavity opening.

In accordance with still another and/or alternative non-limiting aspect of the present invention, there is provided a container opener wherein the body has a varying cross-sectional shape and/or cross-sectional area along the longitudinal length of the body; however, this is not required. In one non-limiting embodiment, the top and bottom end of the body have a generally circular cross-sectional shape; however, it can be appreciated that the top and/or bottom ends of the body can have other shapes (e.g., polygonal, oval, etc.). In another and/or alternative non-limiting embodiment of the invention, the top end of the body has a small cross-sectional area than the bottom end of the body; however, it can be appreciated that the cross-sectional area of both ends can be the same or that the top end can have a larger cross-sectional area than the bottom end. In still another and/or alternative non-limiting embodiment of the invention, the top end and/or bottom end of the body are rounded and/or tapered so as to reduce or eliminate sharp edges on the body of the container opener; however, this is not required. In yet another and/or alternative non-limiting embodiment of the invention, the outer surface of the body includes one or more ribs, slots, grooves, depressions, non-smooth surfaces, high friction surfaces (e.g., rubber, thermoplastic elastomer, etc.) so as to facilitate in the clasping of the body of the container opener when attempting to remove a cap from a bottle or container. In one non-limiting configuration, one or more portions of the outside body of the container opener include or are formed of a high friction surface to facilitate in the grasping of the body of the container opener. In one non-limiting design, one or more portions of the outside body of the container opener include or are formed of a thermoplastic elastomer; however, other or alternative materials can be used. In another and/or alternative non-limiting configuration, the outer surface of the body includes a plurality of ribs and/or grooves to form a non-smooth surface on one or more regions of the body. In another and/or alternative non-limiting configuration, one or more portions of the outer surface of the body are a generally smooth surface and other portions of the outer surface of the body are non-smooth surfaces; however, this is not required. In one non-limiting design that includes this non-limiting configuration, a set of one or more ribs, slots, grooves, depressions, non-smooth surfaces, high friction surfaces (e.g., rubber, thermoplastic elastomer, etc.) form a first clasping region and another set of one or more ribs, slots, grooves, depressions, non-smooth surfaces, high friction surfaces (e.g., rubber, thermoplastic elastomer, etc.) form a second clasping region, and a generally smooth surface separates the first and second clasping regions. In one non-limiting arrangement, the ratio of the total surface area of all of the clasping regions to the total surface area of the generally smooth surface regions located adjacent to the one or more clasping regions are about 0.1-10:1, typically about 0.2-5:1, more typically about 0.5-2:1, and even more typically about 0.8-1.2:1. In still yet another and/or alternative non-limiting embodiment of the invention, the outer shape of the body includes one or more curved regions. These one or more curved regions can be used to facilitate in the gripping and use of the container opener. In one non-limiting configuration, the outer shape of the body is generally pestle-shaped; however, it can be appreciated that other or additional body shapes can be used. Such a configuration of the body results in the varying of the cross-section size and/or shape of the body along the longitudinal length of the body. In another and/or alternative non-limiting embodiment of the invention, the body of the container opening is formed of one piece of material; however, it can be appreciated that the body can be formed of two or more pieces of material. The one or more portions of the body is can formed of a hard and rigid material, or one or more portions of the body can be formed of a flexible and non-rigid material.

In accordance with yet another and/or alternative non-limiting aspect of the present invention, there is provided a container opener wherein the body is formed of one piece of molded, stamped or extruded material (e.g., plastic material, metal material, etc.); however, this is not required. In one non-limiting design of this non-limiting configuration, the body of the container opener is a molded plastic material formed of one or two pieces. When the body is formed by two pieces, the two pieces can be connected together in several ways such as, but not limited to, hot melting, adhesive, sonic welding, etc.

In accordance with another and/or alternative non-limiting aspect of the present invention, there is provided a container opener wherein one or more regions of the body can be formed from a variety of materials (e.g., wood, metal, plastic, fiber reinforced materials, resins, ceramics, etc.) and/or can have a variety of colors (e.g., clear, transparent, semitransparent, non-transparent, blue, purple, white, green, red, tan, wood grain, chrome, etc.).

In accordance with still another and/or alternative non-limiting aspect of the present invention, there is provided a container opener wherein the cavity of the body includes one or more tapered tabs to facilitate in the insertion of the cap of a bottle or container at least partially into the cavity and/or to facilitate in the one or more tabs engaging the cap of the bottle or container; however, this is not required. Many types of medicine bottles or containers include childproof caps that have one or more notches or slots in the cap. The cavity of the container opener can be designed such that one or more tabs are positioned in the cavity so that such one or more tabs engage the one or more notches or slots in the cap when the cap is at least partially inserted into the cavity of the container opener. The tapering of one or more of the tabs can assist in the ease to which the one or more tabs align, engage and/or position themselves in the one or more notches or slots in the cap when the cap is at least partially inserted into the cavity of the container opener.

In accordance with yet another and/or alternative non-limiting aspect of the present invention, there is provided a container opener wherein the cavity in the body only partially extends through the longitudinal length of the body; however, this is not required.

In accordance with still vet another and/or alternative non-limiting aspect of the present invention, there is provided a container opener wherein the cavity in the body extends through the complete longitudinal length of the body; however, this is not required.

In accordance with another and/or alternative non-limiting aspect of the present invention, there is provided a container opener that includes a magnifier; however, this is not required. The magnifier can be used to aid a user in reading text on a medical bottle or container; however, the magnifier can be used for other or additional reasons. The magnifier, when used, can be one or more glass and/or plastic lenses that are mounted in one or more regions on the body of the container opener. In one non-limiting embodiment, one or more lenses are connected to the body at or spaced from the top end or bottom end of the body. The one or more lenses can be connected to the body in a variety of arrangements (e.g., adhesive, friction fit, melted seam, slot or groove arrangement, etc.). When one or more lenses are spaced from the top end of the body, the one or more lenses are typically positioned in the cavity of the body and above the gripping elements in the cavity of the body. The one or more lenses that are connected to the body can be designed to magnify information when viewing the one or more lenses from the top end and/or the bottom end of the body. In one non-limiting arrangement, the one or more lenses are designed to magnify text and/or other objects when the user looks through the cavity opening at the bottom end of the body. In one non-limiting design, one or more lenses are positioned at or near the top end of the body. In another and/or alternative non-limiting design, one or more lenses are positioned at the top end of the body; or no more than about 2 inches from the top end, typically no more than about 1 inch from the top end, and more typically no more than about 0.5 inches from the top end of the body. Viewing the one or more lenses from the cavity opening at the bottom end of the body can result in the boosting of the contrast of the text due to the darker cavity of the body, thereby simulating the view as one would see through an eyepiece of a camcorder. In addition, the viewing of the one or more lenses from the cavity opening at the bottom end of the body can result in the reduction of shadowing about the text and/or viewed object, which shadowing effect can impair the view of the text and/or object. In another and/or alternative non-limiting arrangement, the one or more lenses are designed to magnify text and/or other objects when the user looks through a top cavity opening at the top end of the body. In one non-limiting design, one or more lenses are positioned at or near the top end of the body. In another and/or alternative non-limiting design, one or more lenses are positioned at the top end of the body; or at least 0.5 inches from the bottom end, typically at least about 0.75 inches from the bottom end, and more typically at least about 1 inch from the bottom end of the body. In another and/or alternative non-limiting embodiment, the body of the container opener can include one or more lights to assist the user in viewing text and/or an object through the magnifier; however, this is not required. When one or more lights are used, the one or more lights are typically positioned in the cavity of the body; however, this is not required.

In accordance with still another and/or alternative non-limiting aspect of the present invention, there is provided a container opener having a cavity that includes a plurality of landings that extend from the cavity wall toward the middle of the cavity. In one non-limiting embodiment, each of the landings is designed to engage the top surface and/or top edge of a cap when the cap is inserted into the cavity, thereby functioning as a stop for the cap. The cross-sectional area of the cavity decreases as each landing is spaced farther from the bottom end of the body. For example the cross sectional area of the cavity at the first landing closest to the bottom end is generally at least about 3% greater cross-sectional area than the second landing that is spaced farther from the bottom end than the first landing, typically at least about 5% greater cross-sectional area than the second landing that is spaced farther from the bottom end than the first landing, more typically about 5-20% greater cross-sectional area than the second landing that is spaced farther from the bottom end than the first landing, and even more typically at least about 8-15% greater cross-sectional area than the second landing that is spaced farther from the bottom end than the first landing. The larger cross-sectional area of the cavity defined about the first landing is designed to receive large sized caps on the bottle or container. If the cap has a cross-sectional area that is less than the cross-sectional area of the cavity defined about the first landing, the cap then continues to enter the cavity until reaching the seconding landing. If the cap has a cross-sectional area that is less than the cross-sectional area of the cavity defined about the second landing, the cap then continues to enter the cavity until reaching the third or subsequent landing. When the cavity includes three landings, the cross sectional area of the cavity at the second landing that is closer to the bottom end than the third landing is generally at least about 5% greater than the third landing that is spaced farther from the bottom end than the second landing, typically at least about 10% greater than the third landing that spaced farther from the bottom end than the second landing, more typically about 10-45% greater than the third landing that is spaced farther from the bottom end than the second landing, and even more typically at least about 15-30% greater than the third landing that is spaced farther from the bottom end than the second landing. When the cavity includes four landings, the cross sectional area of the cavity at the third landing that is closer to the bottom end than the fourth landing is generally at least about 3% greater than the fourth landing that is spaced farther from the bottom end than the third landing, typically at least about 5% greater than the fourth landing that is spaced farther from the bottom end than the third landing, more typically about 10-45% greater than the fourth landing that is spaced farther from the bottom end than the third landing, and even more typically at least about 12-35% greater than the fourth landing that is spaced farther from the bottom end than the third landing. As can be appreciated, the container opening of the present invention can include one landing, two landings, three landings, four landings, or more than four landings.

In accordance with yet another and/or alternative non-limiting aspect of the present invention, there is provided a container opener having a cavity that includes one or more gripping elements at or near one or more of the landings in the cavity. In one non-limiting embodiment, each landing includes a plurality of gripping elements. In one non-limiting arrangement, each landing includes a plurality of ribs and/or tabs. In another and/or alternative non-limiting embodiment, the gripping elements on each landing are generally the same shape and/or size; however, this is not required. In still another and/or alternative non-limiting embodiment, adjacently positioned gripping elements on each landing are generally spaced at equal distances apart from one another; however, this is not required. In yet another and/or alternative non-limiting embodiment, the number of gripping elements on the first landing that are closest to the bottom end of the body is greater than the number of gripping elements on the second landing; however, this is not required. In still yet another and/or alternative non-limiting embodiment, the circumferential position of a plurality of the gripping elements on the first landing that is closest to the bottom end of the body is different from the circumferential position of a plurality of the gripping elements on the second landing. As can be appreciated, the gripping elements on one landing can be generally aligned about the circumference of the cavity with gripping elements on another landing; however, this is not required.

In accordance with still yet another and/or alternative non-limiting aspect of the present invention, there is provided a container opener having a cavity that has a tapered cavity opening to facilitate in the insertion of the cap of a bottle or container into the cavity of the container opener; however, this is not required.

It is one non-limiting object of the present invention to provide a container opener that enables a user to open a pill bottle or container with minimal hand strength and dexterity.

It is another and/or alternative non-limiting object of the present invention to provide a container opener that is portable and convenient to use.

It is still another and/or alternative non-limiting object of the present invention to provide a container opener that can be use to open a variety of sized caps on pill bottles or containers.

It is yet another and/or alternative non-limiting object of the present invention to provide a container opener that includes a magnifier.

These and other objects and advantages will become apparent to those skilled in the art upon reading and following the description taken together with the accompanying drawings.

BRIEF DESCRIPTION OF THE DRAWINGS

Reference may now be made to the drawings which illustrate various preferred embodiments that the invention may take in physical form and in certain parts and arrangement of parts wherein.

DETAILED DESCRIPTION OF THE PREFERRED EMBODIMENT

Figure 1:
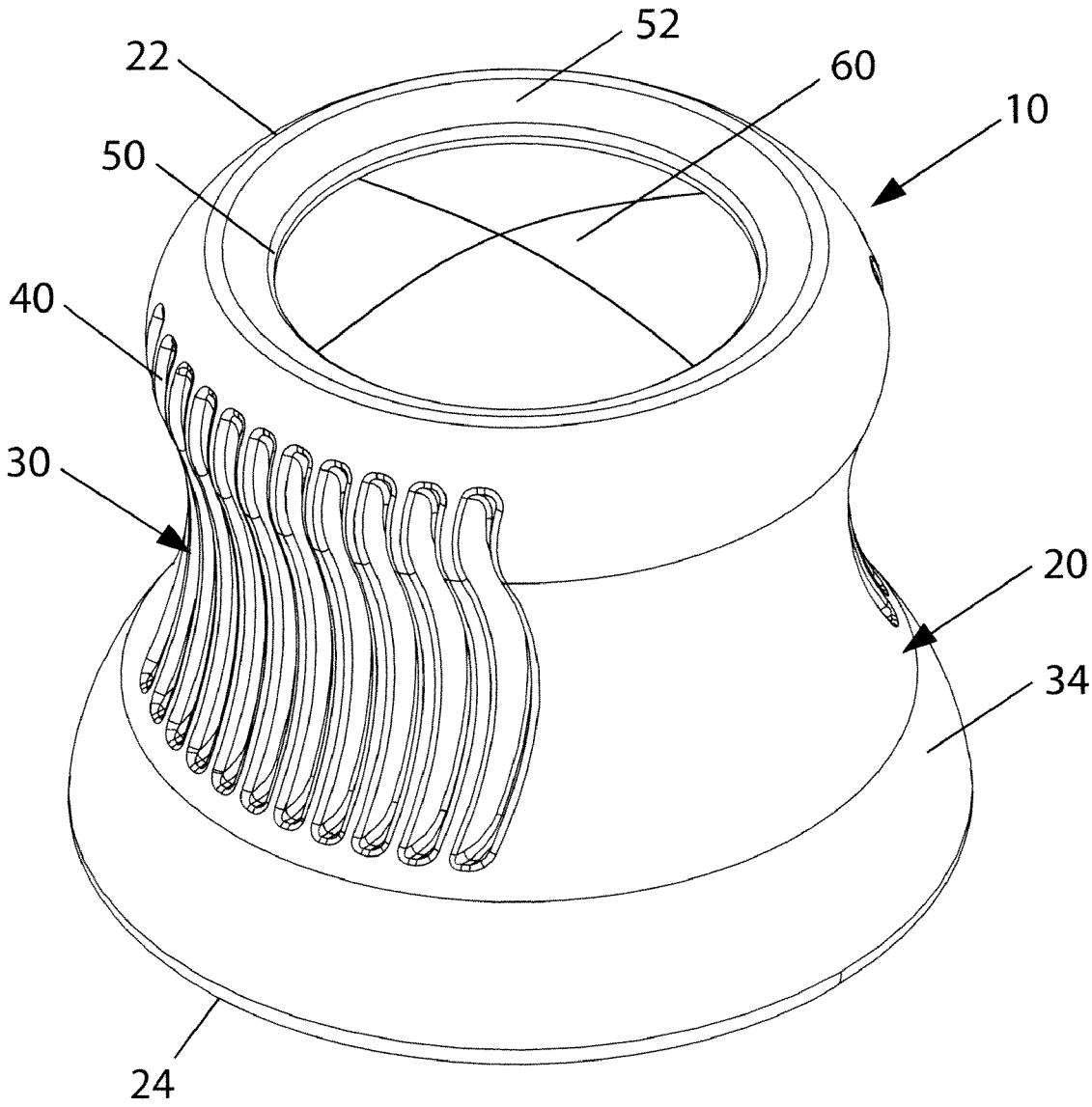
FIG. 1 is perspective view of one non-limiting embodiment of a container opener in accordance with the present invention.

Referring now to the drawings wherein the showings are for the purpose of illustrating a preferred embodiment of the invention only and not for the purpose of limiting same, FIGS. 1-6 illustrate one non-limiting embodiment of the container opener in accordance with the present invention.

Referring now to FIG. 1, there is illustrated a container opener 10 that includes a body 20 that has top and bottom ends 22, 24. Body 20 can be formed from one or more materials. Body 20 can be formed from one or more sections. As illustrated in FIG. 1, body 20 is a one piece member. In one non-limiting arrangement, body 20 is a molded piece of plastic. It will be appreciated that body 20 can be formed of other materials and/or be formed in a different manner. The color and/or transparency of body 20 is non-limiting. The outer surface of body 20 can include graphic designs, printed material, logos, etc.; however, this is not required.

The outer surface of body 20 includes at least one clasping region 30. The clasping regions are designed to improve a user's grip on the body of the container opener when attempting to remove a cap from a bottle or container, not shown. As best illustrated in FIGS. 3B and 4, the outer surface of body 20 includes two clasping regions 30, 32; however, it will be appreciated that body 20 can include only one clasping region or more than two clasping regions. Each of the clasping regions is formed of a plurality of grooves 40 which creates a non-smooth surface in the clasping region. As can be appreciated, other or additional structures (e.g., ribs, bumps, etc.) can be used to form a non-smooth area in one or more of the clasping regions. Grooves 40 are illustrated as the same shape and size; however, this is not required. Grooves 40 are illustrated as positioned between top and bottom ends 22, 24: however, it can be appreciated that one or more of the grooves can extend to the top or bottom end of body 20.

Figure 3A:
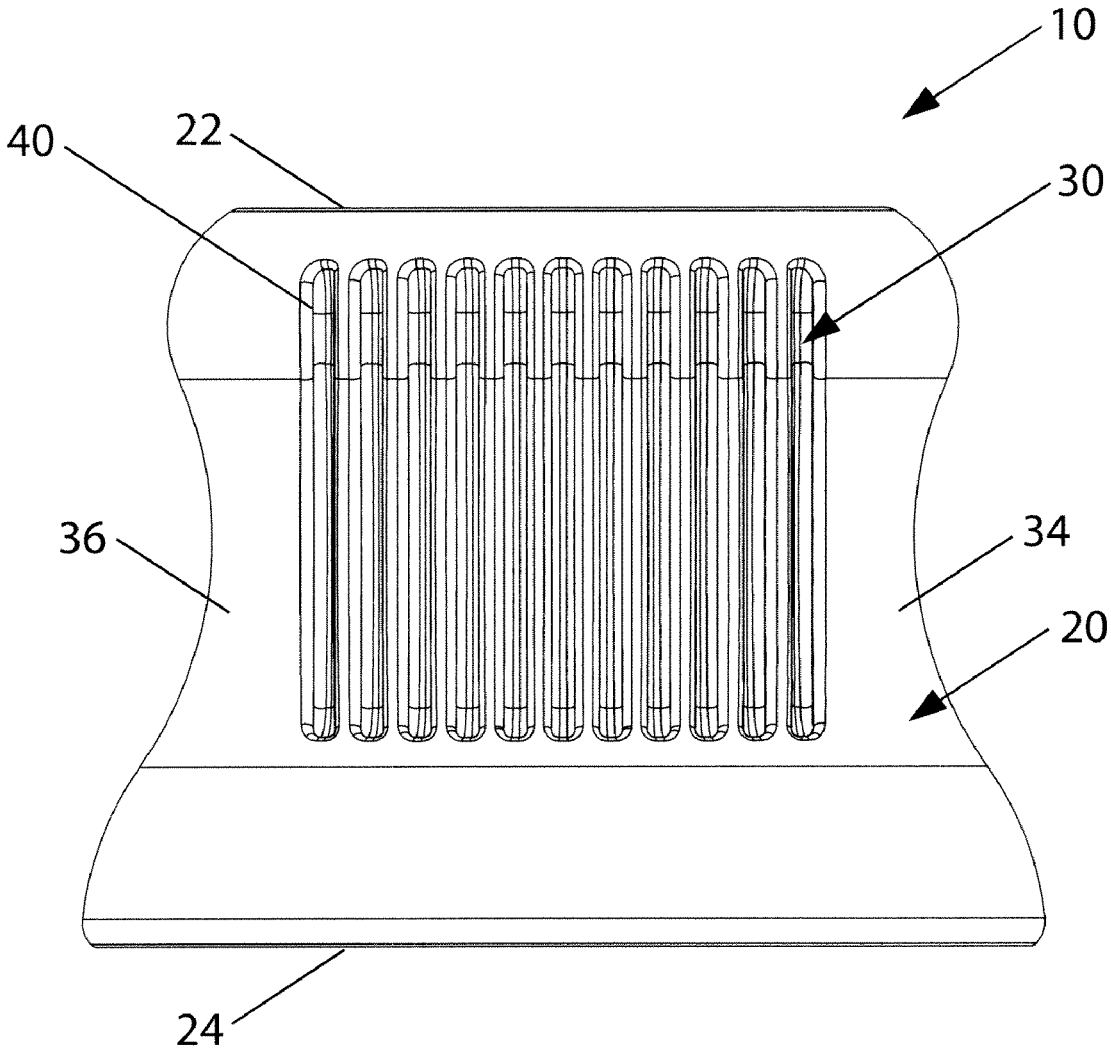
FIGS. 3A and 3B are two different side views of the container opener of FIG. 1.
Figure 3B:
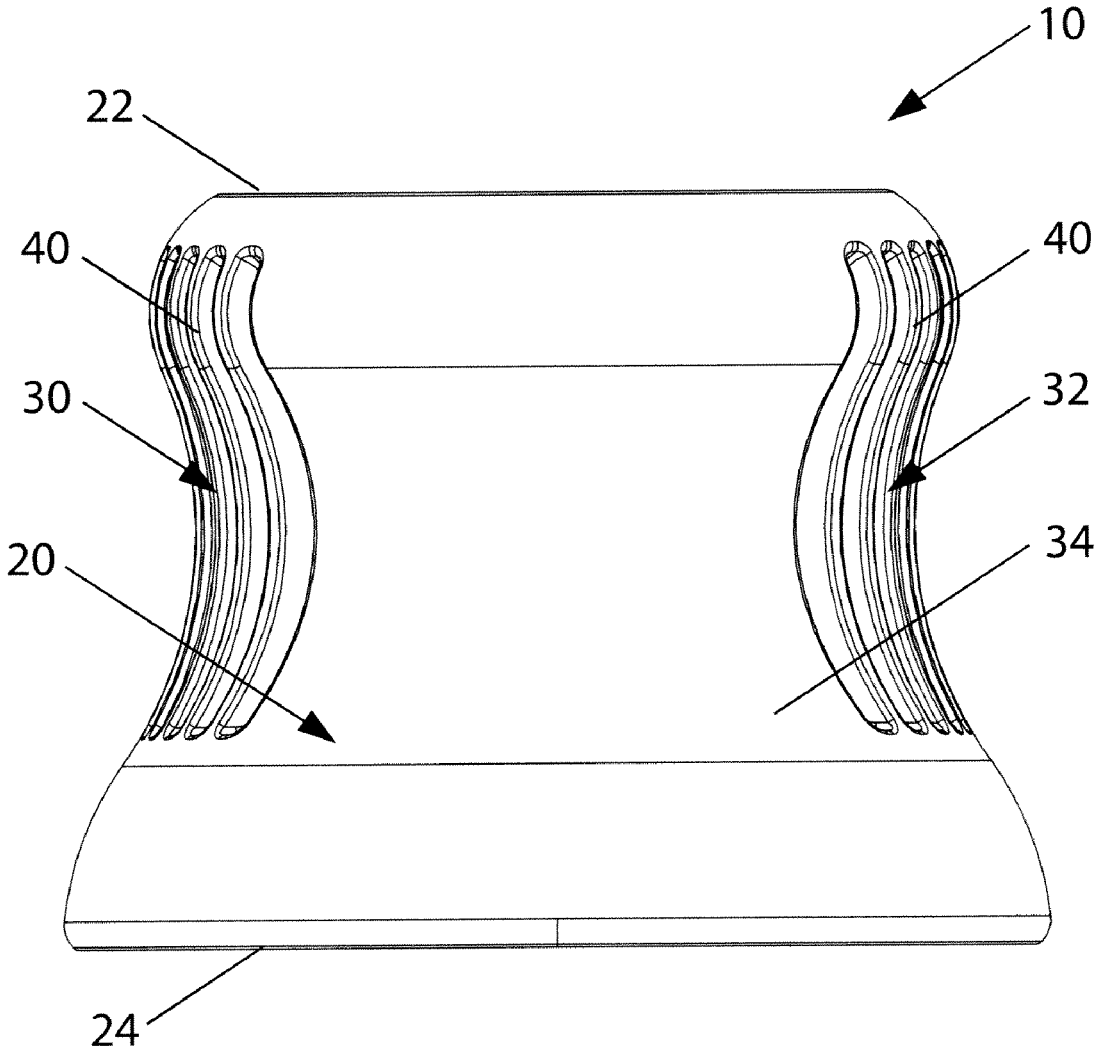
Figure 4:
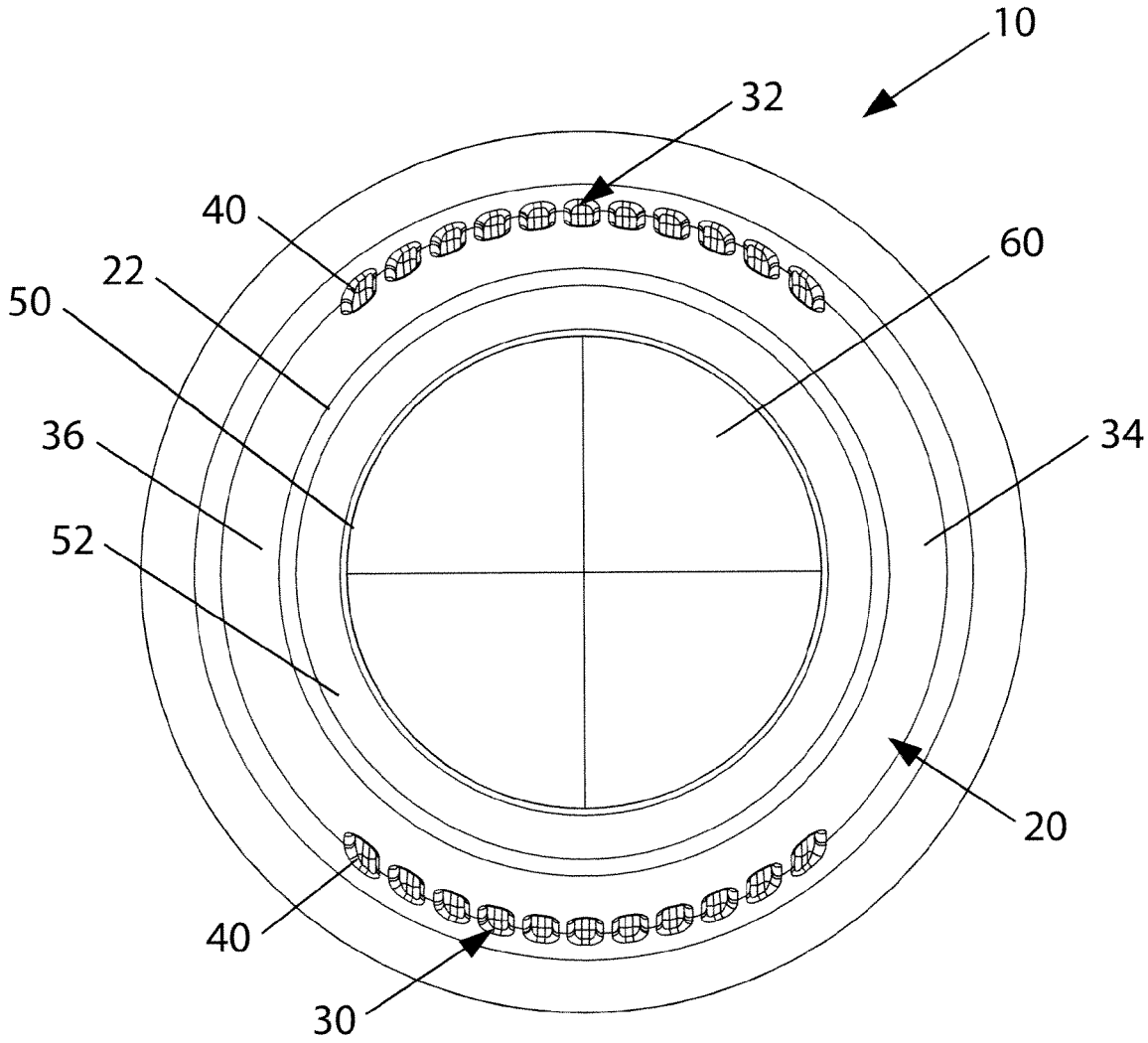
FIG. 4 is a top view of the container opener of FIG. 1.

As best illustrated in FIGS. 3A, 3B and 4, the two clasping regions 30, 32 are separated by generally smooth regions 34, 36. As can be appreciated, body 20 does not require smooth regions or clasping regions. As such, the complete outer surface of body 20 can include a clasping region or a smooth region. The two smooth regions 34, 36 are illustrated as covering more of the outer surface area of body 20 than clasping regions 30, 32; however, this is not required.

The shape of the outer surface of body 20 is generally in the form of a pestle-shape; however, other shapes can be used. As best illustrated in FIGS. 3A and 3B, the cross-sectional area of body 20 in the middle region of body 20 is less than the cross-section area of body 20 at the top and bottom ends 22, 24 of body 20; however, this is not required. As also illustrated in FIGS. 3A and 3B, the cross-sectional area of body 20 at top end 22 is less than the cross-section area of body 20 at bottom end 24; however, this is not required. The cross-sectional shape of body 20 along the longitudinal length of body 20 is generally circular; however, it can be appreciated that one or more regions of body 20 along its longitudinal length can have other cross-sectional shapes. In one non-limiting design of body 20, top end 22 has a diameter of about 1.9-2.0 inches, bottom end 24 has a diameter of about 2.2-2.5 inches, the thinnest diameter of body 20 is about 1.63-1.88 inches, and the height of body 20 is about 2.55-2.7 inches. As set forth in this non-limiting design, the height of body 20 is generally greater than the maximum diameter or width of body 20; however, this is not required.

Referring now to FIGS. 1 and 4, the top of body 20 can include an opening; however, this is not required. When the top of body 20 includes an opening 50, the opening can include a magnifier such as one or more lenses 60. The degree of magnification of the one or more lenses 60 is non-limiting. As best illustrated in FIG. 1, the top end includes a tapered or sloped surface 52 that tapers or slopes downwardly; however such tapered or sloped surface is not required. As illustrated in FIG. 1, tapered or sloped surface 52 results in a single lens 60 being mounted in opening 50 such that the top surface of lens 60 is spaced downwardly from top end 22. Such an arrangement reduces the incidence of scratching lens 60 when the top end of container opener 10 rests on a hard surface. As can be appreciated, such a mounting arrangement for lens 60 is not required. Lens 60 is typically formed of a plastic material; however, other materials can be used. Lens 60 can be designed for viewing from the top or bottom ends of body 20. Lens 60 can be secured in opening 50 in any number of ways (e.g., friction fit, adhesive, groove arrangement, etc.).

Figure 2:
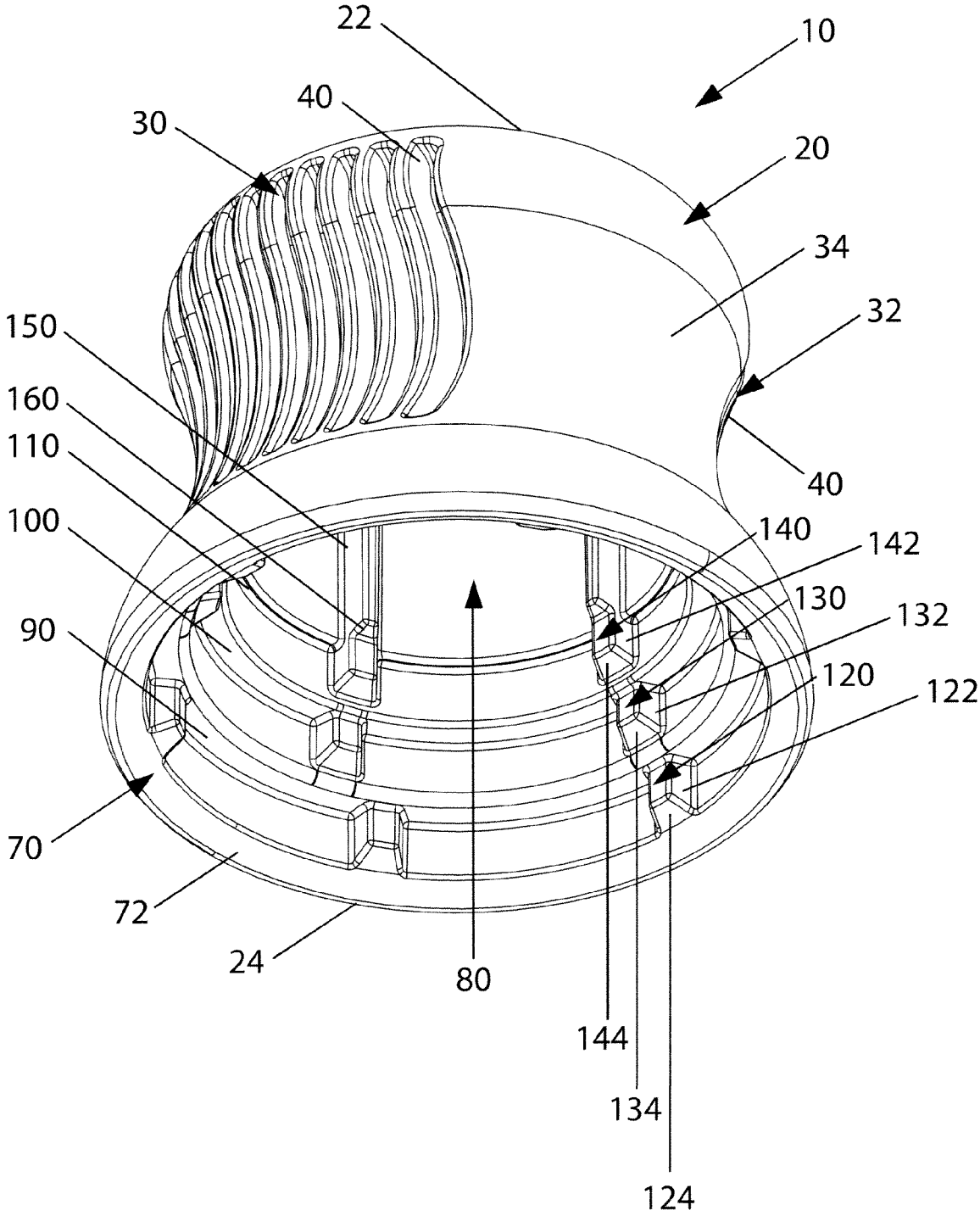
FIG. 2 is a front elevation view of the container opener of FIG. 1.
Figure 5:
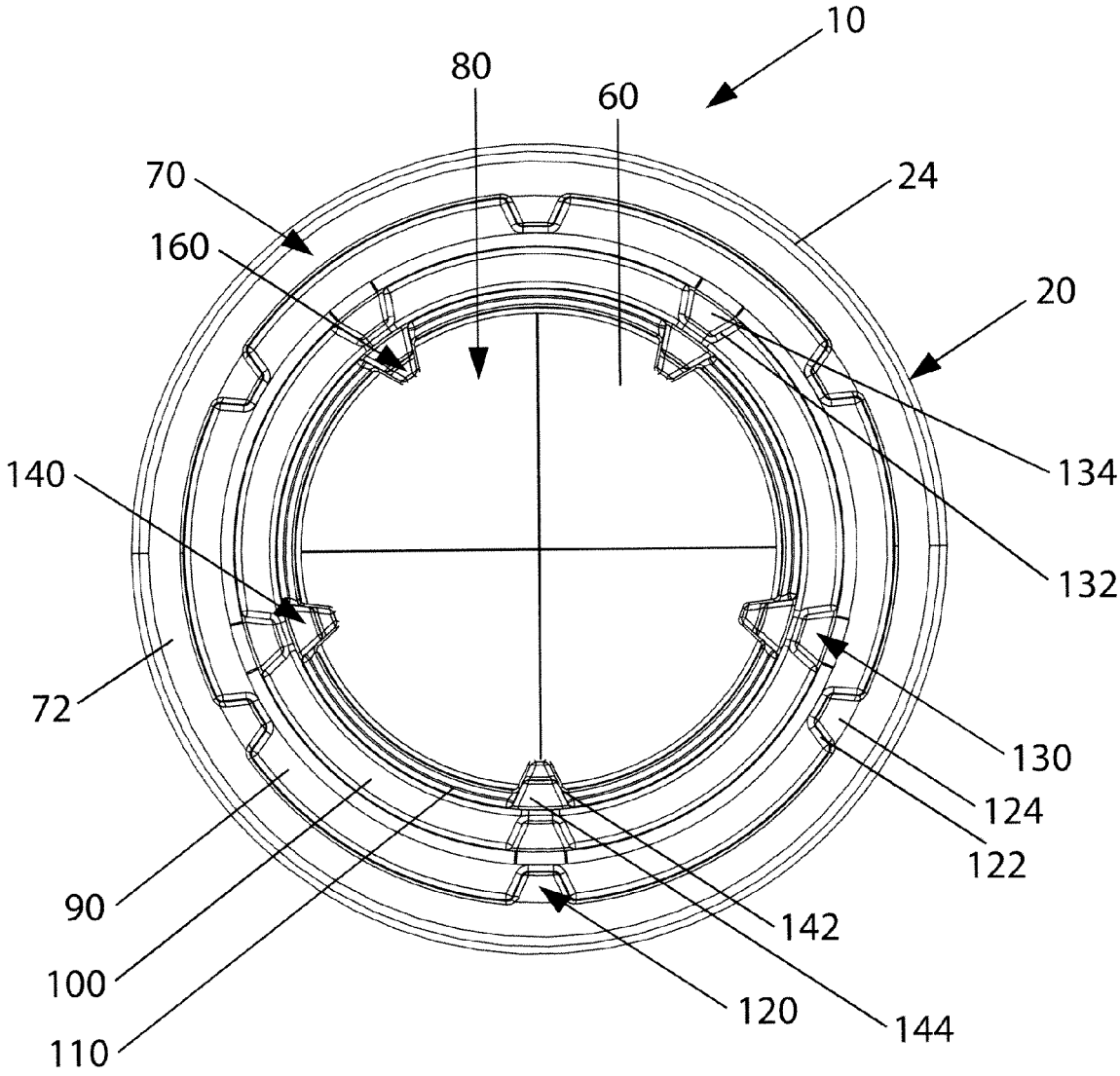
FIG. 5 is a bottom view of the container opener of FIG. 1.
Figure 6:
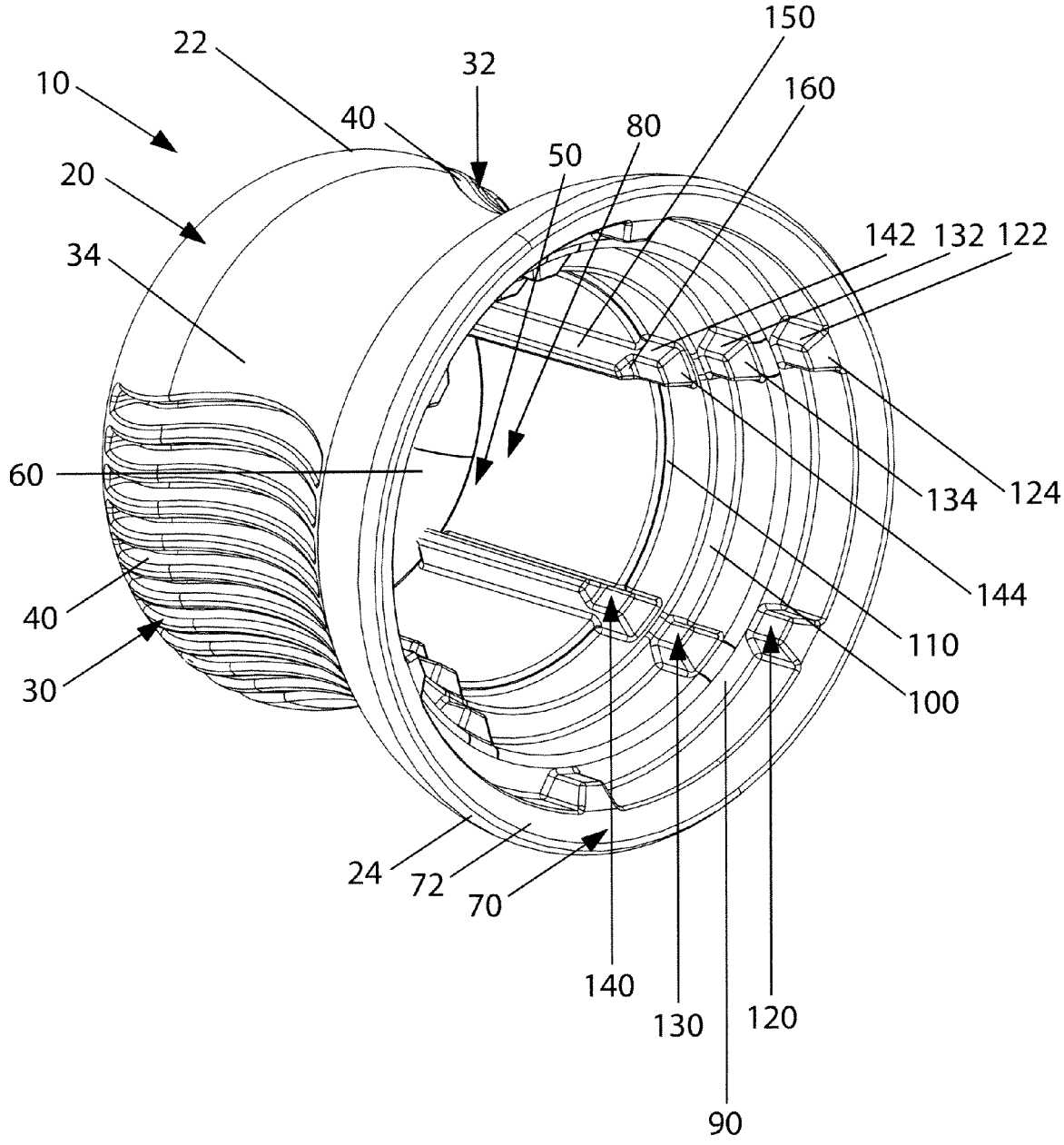
FIG. 6 is a bottom elevation view of the container opener of FIG. 1; and, FIGS. 7 and 8 illustrate the insertion of the container opener of FIG. 1 onto two different sized bottles having caps.

Referring now to FIGS. 2, 5 and 6, bottom end 24 includes a cavity opening 70 that provides an entrance into cavity 80. As illustrated in FIGS. 2, 5 and 6, bottom end includes a tapered or sloped surface 72 that tapers or slopes upwardly until terminating into cavity opening 70. Tapered or sloped surface 72 can facilitate in the insertion of a cap of a bottle or container, not shown, at least partially into cavity 80. As can be appreciated, tapered or sloped surface 72 is not required.

As best illustrated in FIG. 5, cavity opening 70 has a generally circular cross-sectional shape; however, it will be appreciated that cavity opening 70 can have other cross-sectional shapes.

Three landings 90, 100, 110 are positioned in cavity 80. As can be appreciated, cavity 80 can include a smaller number or a greater number of landings. Each of the three landings is illustrated as encircling the inside perimeter of cavity 80; however, it will be appreciated that one or more of the landings only partially encircle the inside perimeter of cavity 80. Landing 90 is illustrated as located closest to bottom end 24, landing 100 is illustrated as located the second closest to bottom end 24, a landing 110 is illustrated as located the farthest from bottom end 24. As best illustrated in FIG. 5, the cross-sectional area of cavity 80 at landing 90 is greater than the cross-sectional area of cavity 80 at landing 100. Likewise, the cross-sectional area of cavity 80 at landing 100 is greater than the cross-sectional area of cavity 80 at landing 110. The differing cross-sectional areas of cavity 80 at each of the three landings are designed to engage different sized caps on a bottle or container that is at least partially inserted into cavity 80. As illustrated in FIG. 5, the cross-sectional shape of cavity 80 at each landing is generally circular; however, it can be appreciated that cavity 80 can have different cross-sectional shapes at one or more landings. In one non-limiting design of body 20, the diameter of cavity 80 at landing 90 is about 1.9-2.1 inches, the diameter of cavity 80 at landing 100 is about 1.7-1.89 inches, and the diameter of cavity 80 at landing 110 is about 1.5-1.69 inches. In this non-limiting design of body 20, landing 90 prevents further entrance of a cap into cavity 80 when the cap has a diameter of less than 2.1 inches to about 1.9 inches, landing 100 prevents further entrance of a cap into cavity 80 when the cap has a diameter of less than 1.9 inches to about 1.7 inches, and landing 110 prevents further entrance of a cap into cavity 80 when the cap has a diameter of less than 1.7 inches to about 1.5 inches. As will be described in detail below, one or more of the structural ribs 150 can include a sloped surface 160 designed to engage smaller sized caps. In accordance with the non-limiting design of body 20 as described above, sloped surfaces 160 can be designed to prevent further entrance of a cap into cavity 80 when the cap has a diameter of less than 1.25 inches to about 1.49 inches. As can be appreciated, the size of landings 90, 100 and 110, and/or sloped surface 160 and structural ribs 150 can be modified to accommodate other size ranges of caps.

Cavity 80 can be designed to terminate after the last landing, or cavity 80 can extend upwardly to top end 22 as illustrated in FIG. 5. The cross-sectional shape and size of the cavity between the last landing and top end 22 is non-limiting. As illustrated in FIG. 5, cavity 80 has a generally circular cross-sectional shape and maintains a generally constant cross-sectional area from landing 110 to opening 50. Generally the cross-sectional area of cavity 80 above landing 110 is less than the cross-sectional area of landing 110; however, this is not required. In one non-limiting design of body 20, the cross-section shape of cavity 80 at landing 110 is circular and the cross-section shape of cavity 80 above landing 110 is circular, and the diameter of cavity 80 at landing 110 is about 1.5-1.69 inches and the diameter of cavity 80 above landing 110 is less than 1.5 inches (i.e., 1.3-1.49 inches).

As illustrated in FIGS. 2, 5 and 6, a plurality of tabs 120, 130, 140 are positioned in cavity 80. A plurality of tabs 120 are positioned between tapered or sloped surface 72 and landing 90. As can be appreciated, tabs 120 can extend to or be spaced from tapered or sloped surface 72 and/or landing 90. As illustrated in FIGS. 2, 5 and 6, tabs 120 extend from tapered or sloped surface 72 to landing 90. Cavity 80 is shown to include six (6) tabs 120; however, it can be appreciated that a greater or lesser number of tabs 120 can be included in cavity 80. Adjacently positioned tabs 120 are illustrated as spaced at generally equal distances from one another; however, this is not required. Tabs 120 are illustrated as having sloped or tapered sides 122 and bottom surfaces 124; however, it can be appreciated that only the sides or only the bottom surface can be sloped or tapered or no portion of tabs 120 need to be sloped or tapered. The sloped or tapered surfaces on the sides and/or bottom of tabs 120, when used, facilitate in the insertion of a cap on a bottle or container, not shown, into cavity 80 and/or facilitate in the tabs being positioned in slots or groove in the cap on a bottle or container, not shown, thereby engaging the cap for subsequent removal of the cap from the bottle or container.

Referring again to FIGS. 2, 5 and 6, a plurality of tabs 130 are positioned between landing 90 and landing 100. As can be appreciated, tabs 130 can extend to or be spaced from landing 90 and/or landing 100. As illustrated in FIGS. 2 and 6, tabs 130 extend from landing 90 to landing 100. Cavity 80 is shown to include five (5) tabs 130; however, it can be appreciated that a greater or lesser number of tabs 130 can be included in cavity 80. Adjacently positioned tabs 130 are illustrated as spaced at generally equal distances from one another; however, this is not required. Tabs 130 are illustrated as having sloped or tapered sides 132 and bottom surfaces 134; however, it can be appreciated that only the sides or only the bottom surface can be sloped or tapered or no portion of tabs 130 need to be sloped or tapered. The sloped or tapered surfaces on the sides and/or bottom of tabs 130, when used, facilitate in the insertion of a cap on a bottle or container, not shown, into cavity 80 and/or facilitate in the tabs being positioned in slots or groove in the cap on a bottle or container, not shown, thereby engaging the cap for subsequent removal of the cap from the bottle or container.

Referring once again to FIGS. 2, 5 and 6, a plurality of tabs 140 are positioned between landing 100 and landing 110. As can be appreciated, tabs 140 can extend to or be spaced from landing 100 and/or landing 110. As illustrated in FIGS. 2 and 6, tabs 140 extend from landing 100 to landing 110. Cavity 80 is shown to include five (5) tabs 140; however, it can be appreciated that a greater or lesser number of tabs 140 can be included in cavity 80. Adjacently positioned tabs 140 are illustrated as spaced at generally equal distances from one another; however, this is not required. Tabs 140 are illustrated has having sloped or tapered sides 142 and bottom surfaces 144; however, it can be appreciated that only the sides or only the bottom surface can be sloped or tapered or no portion of tabs 140 need to be sloped or tapered. The sloped or tapered surfaces on the sides and/or bottom of tabs 140, when used, facilitate in the insertion of a cap on a bottle or container, not shown, into cavity 80 and/or facilitate in the tabs being positioned in slots or groove in the cap on a bottle or container, not shown, thereby engaging the cap for subsequent removal of the cap from the bottle or container.

Referring now to FIGS. 2 and 6, structural ribs 150 extend upwardly from landing 100. These structural ribs are optional; however, when used, provide rigidity and strength to body 20. As illustrated in FIGS. 2 and 6, five (5) structural ribs 150 are positioned in cavity 80; however, a greater or lesser number of structural ribs can be present in cavity 80. The adjacently positioned structural ribs 150 are illustrated as spaced at generally equal distances from one another; however, this is not required. FIGS. 2 and 6 also illustrate that the base of one or more of the structural ribs 150 can be modified to include a sloped region 160 that can be used to engage cap sizes that are even smaller than caps designed to be engaged by landing 110 and tabs 140 as described above. Sloped region 160 can include tapered to facilitate in engagement of a cap that is inserted into cavity 80.

Figure 7:
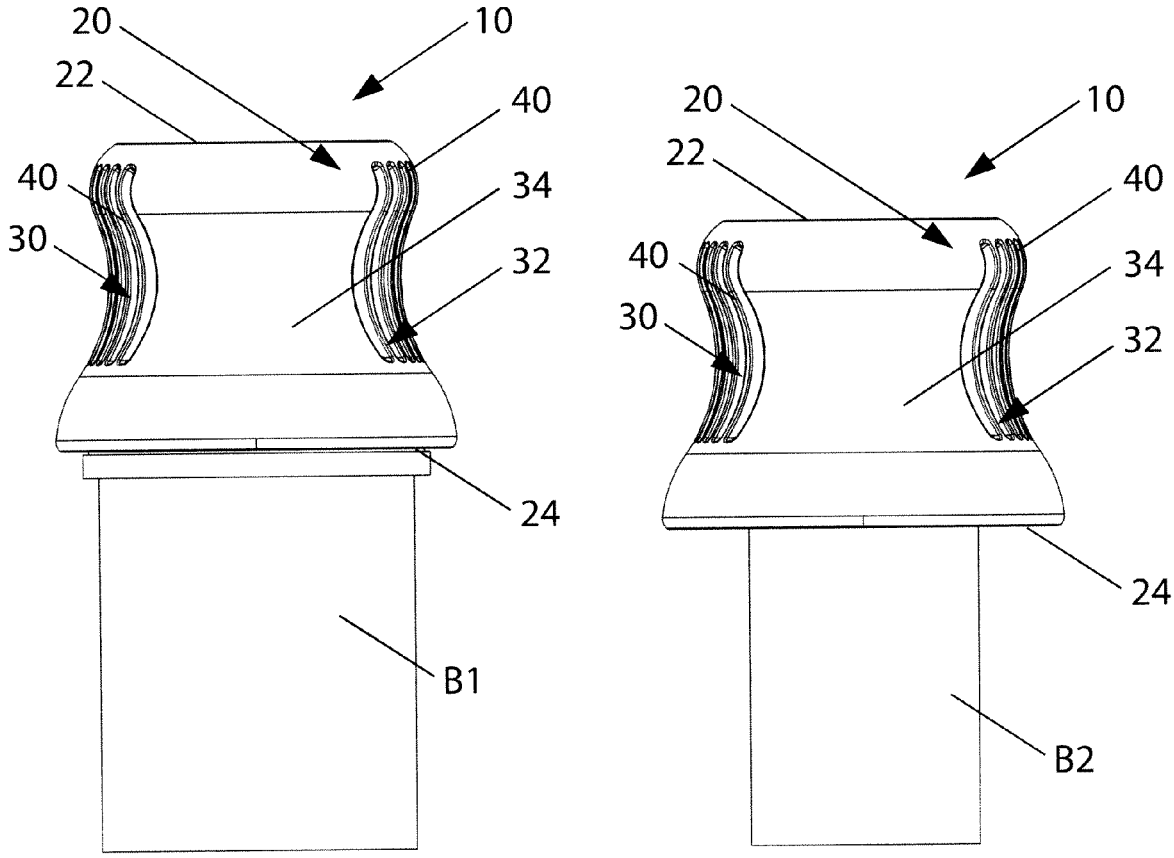
Figure 8:
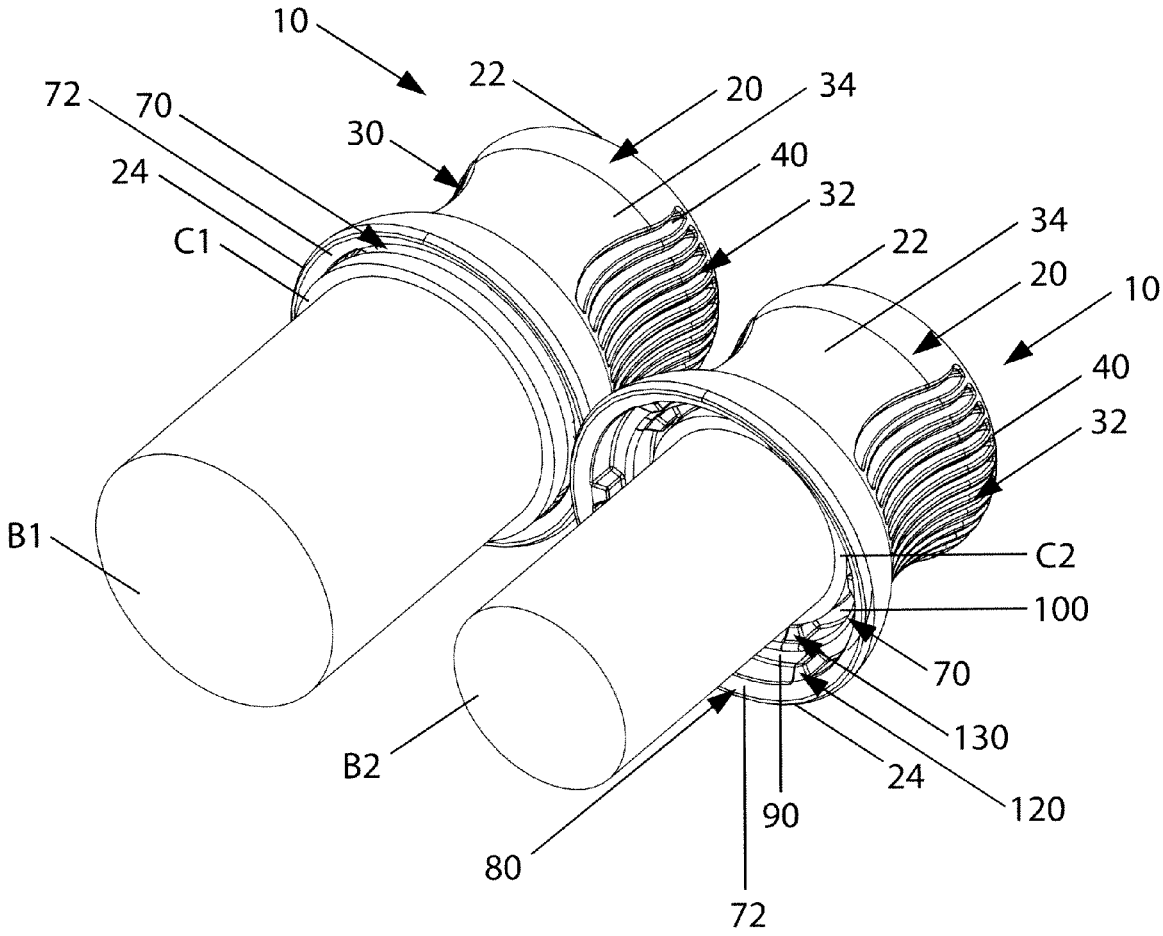

Referring to FIGS. 7 and 8, the use of container opener 10 is illustrated. Two different sized bottles B1 and B2 are shown as used with container opener 10. Bottle B1 has a generally cylindrical body and a cap C1. Likewise, bottle B2 has a generally cylindrical body and a cap C2. The diameter of the body of B1 and cap C1 is greater than the body of bottle B2 and cap C2. As best illustrated in FIG. 8, the diameter of cap C1 is such that it can be at least partially telescopically received in through cavity opening 70 and into cavity 80 until the top edge of the cap C1 engages landing 90 and tabs 120 engage slots in the side of cap C1, not shown. The diameter of cap C2 is such that it can be at least partially telescopically received in through cavity opening 70 and into cavity 80 until the top edge of the cap C2 engages landing 110 and tabs 140 engage slots in the side of cap C2, not shown. Once the container opener 10 is fitted over and about the cap on the bottle, a user merely grasps body 20 of container opener 10 and easily twists off the cap of the bottle. If the cap of a child safety cap, the user merely has to first press downwardly on the top of body 20 of container opener 10 and then merely twist off the child safety cap from the bottle. The size and shape of body 20 of container opener 10 can be selected for easy and comfortable grasping of the body so that a cap can be easily and conveniently removed from a bottle. As illustrated in FIGS. 7 and 8, body 20 of container opener 10 can include one or more clasping regions 30, 32 to improve or increase the ease to which a user is able to grasp the body of the container opener when attempting to remove a cap from a bottle.

The container opener described above can enable the elderly, people with physical disabilities, and/or people with poor eyesight to more easily remove a cap from a bottle or container and/or read text on the bottle or container. Many bottles or containers that include medicine include childproof caps that perform an excellent job of keeping children from accessing and ingesting the medicine. Although these childproof caps are very effective for their intended purpose these childproof caps can make such medicine bottles or containers difficult, if not impossible, for some adults to open, especially adults with arthritis or other physical disabilities. The container opener of the present invention is designed to ease the discomfort from having to open medicine bottles or container; especially ones that include childproof caps. The container opener of the present invention allows a user to simply insert the container opener on a cap and then push and turn the container opener to remove the cap from the bottle or container. The body of the container opener can be ergonomically designed to ease the handling and/or use of the container opener. The size of the container opener is designed for ease of grasping so that a user can easily push down and/or turn the container opener when removing a cap from a bottle or container. The container opener can be designed for use with different sized caps for different types of bottles or containers. The container opener can include gripping elements such as tabs to engage radial grooves in the cap on a bottle or container to thereby facilitate in the turning of the cap. Due to the container opener of the present invention, the user can maintain his/her medications in the proper containers and easily access such medications by use of the container opener of the present invention. As a result, the medications stay in the properly marked containers and children cannot easily access the medications in the childproof bottles or containers. For a user with vision loss or impairment, the container opener of the present invention can include a magnifier to aid in reading small text on the bottle or container (e.g., dosage requirements, warnings, type of medication, etc.).

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween.

What is claimed is:

1. A container opener that includes a body having top and bottom ends, upper and lower cavity openings, and a single cavity extending through said body and from said upper cavity opening to said lower cavity opening, said lower cavity opening positioned at a bottom end of said body and designed to receive a container cap, said single cavity having a central axis, said single cavity including first and second landings and first and second set of ribs, said first and second landings and said first and second set of ribs extend outwardly from an inner surface of said single cavity and toward said central axis, said first landing positioned closer to said bottom end than said second landing, said single cavity having a greater cross-sectional area at said first landing than at said second landing, said first set of ribs extending downwardly from said first landing, said second set of ribs extending downwardly from said second landing, said distance between said central axis and said first landing less than said distance between said central axis and said first set of ribs, said distance between said central axis and said second landing less than said distance between said central axis and said second set of ribs, said distance between said central axis and said second landing less than said distance between said central axis and said first landing, said first and second landings and said first and second set of ribs designed to engage the cap on the container when the cap is at least partially inserted in said single cavity, said first landing designed to engage a larger cross-sectional area cap than said second landing, said single cavity including a magnifier that enables a user to look fully or partially through said single cavity and view enlarged objects located in said single cavity or below said lower cavity opening, said magnifier positioned above said second landing.

2. The container opener as defined in claim 1, wherein said first set of ribs has a larger number of ribs than said second set of ribs.

3. The container opener as defined in claim 1, wherein said first and second set of ribs include a tapered or sloped bottom surface.

4. The container opener as defined in claim 2, wherein said first and second set of ribs include a tapered or sloped bottom surface.

5. The container opener as defined in claim 1, wherein an outer surface of said body includes at least one clasping region, said clasping region having a non-smooth surface.

6. The container opener as defined in claim 4, wherein an outer surface of said body includes at least one clasping region, said clasping region having a non-smooth surface.

7. The container opener as defined in claim 1, wherein a cross-sectional area of a top end of said body is smaller than a cross-sectional area of said bottom end of said body.

8. The container opener as defined in claim 6, wherein a cross-sectional area of a top end of said body is smaller than a cross-sectional area of said bottom end of said body.

9. The container opener as defined in claim 1, wherein said magnifier is located in said single cavity and spaced below said upper end of said body.

10. The container opener as defined in claim 8, wherein said magnifier is located in said single cavity and spaced below said upper end of said body.

11. The container opener as defined in claim 1, wherein said bottom end of said body is tapered.

12. The container opener as defined in claim 10, wherein said bottom end of said body is tapered.

13. The container opener as defined in claim 1, including a set of structural ribs in said single cavity, said set of structural ribs extending outwardly from said inner surface of said single cavity and toward said central axis, said set of structural ribs positioned between said upper cavity opening and said second landing.

14. The container opener as defined in claim 12, including a set of structural ribs in said single cavity, said set of structural ribs extending outwardly from said inner surface of said single cavity and toward said central axis, said set of structural ribs positioned between said upper cavity opening and said second landing.

15. The container opener as defined in claim 1, wherein said magnifier is at least partially mounted by a friction fit in said single cavity.

16. The container opener as defined in claim 14, wherein said magnifier is at least partially mounted by a friction fit in said single cavity.

* * * * *